US009669561B2

(12) United States Patent
Fitzpatrick

(10) Patent No.: US 9,669,561 B2
(45) Date of Patent: Jun. 6, 2017

(54) WEB SLITTER WITH FLEXIBLE WALL BLADE MOUNTING

(71) Applicant: GL&V Luxembourg S.à.r.l., Munsbach (LU)

(72) Inventor: Donald Fitzpatrick, Chatham, NY (US)

(73) Assignee: GL & V Luxembourg Sàrl, Munsbach (LU)

( * ) Notice: Subject to any disclaimer, the term of this patent is extended or adjusted under 35 U.S.C. 154(b) by 23 days.

(21) Appl. No.: 14/645,051

(22) Filed: Mar. 11, 2015

(65) Prior Publication Data

US 2016/0263765 A1 Sep. 15, 2016

(51) Int. Cl.

| | |
|---|---|
| ***B26D 1/14*** | (2006.01) |
| ***B26D 7/26*** | (2006.01) |
| ***B26D 1/143*** | (2006.01) |
| ***B26D 1/22*** | (2006.01) |

(52) U.S. Cl.

CPC ..... *B26D 7/2635* (2013.01); *B26D 1/1435* (2013.01); *B26D 1/225* (2013.01); *B26D 2007/2685* (2013.01)

(58) Field of Classification Search

CPC ..... B26D 7/2635; B26D 1/1435; B26D 2007/2685; B26D 1/225

USPC ..... 30/44; 83/508.3, 508.2

See application file for complete search history.

(56) References Cited

U.S. PATENT DOCUMENTS

| | | | | |
|---|---|---|---|---|
| 5,127,290 | A * | 7/1992 | Warner | B24D 11/008 300/21 |
| 5,761,980 | A * | 6/1998 | Ima | B26D 1/225 83/425.4 |
| 6,226,871 | B1 * | 5/2001 | Eichhorn | B26B 19/048 30/346.51 |
| 7,607,229 | B2 * | 10/2009 | Motohashi | B26B 19/288 30/43.7 |
| 2003/0094861 | A1 * | 5/2003 | Shimizu | H02K 33/10 310/36 |
| 2010/0170373 | A1 * | 7/2010 | Green | B26D 5/04 83/13 |
| 2013/0247390 | A1 * | 9/2013 | Rutan | B26D 7/22 30/390 |
| 2014/0116218 | A1 * | 5/2014 | Kwarta | B26D 1/245 83/425.4 |

* cited by examiner

*Primary Examiner* — Omar Flores Sanchez
(74) *Attorney, Agent, or Firm* — James Earl Lowe, Jr.

(57) ABSTRACT

A web slitter assembly comprising a mechanism connected to a support structure and to a blade housing for holding the blade housing adjacent a band so that the side of a blade contacts the side of the band with an appropriate amount of force. The mechanism comprises a body connected to the support structure, and a pair of flexible walls spaced apart and on opposite sides of a portion of the body. The upper ends of the flexible walls are attached to the support structure, and the lower ends of the flexible walls are attached to the blade housing.

13 Claims, 2 Drawing Sheets

WEB SLITTER WITH FLEXIBLE WALL BLADE MOUNTING

BACKGROUND

Web slitting assemblies are designed to cut continuously running webs in the longitudinal direction. They primarily consist of a blade and a band that contact each other axially at their periphery. The web is drawn through the intersection of the blade and band where it is severed longitudinally. The band is usually but not always driven a few percent faster than the web. The mating edges of the blade and band are ground at various angles to create sharp edges that shear the web.

To accomplish the shear action, the blade and band must be loaded axially against each other. In other words, the band is circular and has a side, and the blade is pressed against the side of the band. The nominal magnitude of the loading will vary depending upon the web product being cut. The precision of the loading will significantly affect the quality of the cut, and the life of the cutting edges of the blade and band.

Traditionally, the means of accomplishing the axial movement required to load a circular blade against a circular band has been to have the blade's axle sliding axially within a bushing. Another method used to a limited extent has been guiding the blade axially by means of a "4 bar linkage". Each of these methods has an inherent drawback. In the case of the "axle and bushing" type of guiding, binding and friction will result in an inconsistent and undetermined load between the blade and the band.

A resisting force, theoretically equal to the designed applied force, is exerted by the band upon the blade at its periphery. This action presents a moment at the blade center that must be resisted by the axle within the bushing. The axle is required to move axially within the bushing while operating, due to minute run out that exists in the band throughout its rotation. Because of envelope restrictions, the ratio of the length of the bushing to the diameter of the axle (known as the L/D ratio) is relatively small. The aforementioned moment causes the axle-blade assembly to skew the axial axis to the extent of whatever clearance may exist in the axle bushing fit. This skewing results in the axial motion binding and therefore causing the intended loading to increase dramatically. Blade damage and wear result. This same phenomenon will occur, to a lesser extent, when a linear shaft bearing is used in place of the bushing referred to above.

In the case of the "4 Bar Linkage" type of guiding, envelope restrictions require that the pivots of the linkages be excessively small. This miniaturization requirement also essentially precludes the ability to include wear resistant elements, such as bearings or bushings, in the pivot design. Although this design, to a large degree, eliminates the binding aspect described for the axel-bushing arrangement, it does suffer from premature wear problems at the pivot points. Clearance in the pivots, even a small, required design clearance, will cause the blade assembly to tip out of the intended plane, that plane being essentially parallel to the face of the band. This compromise in alignment geometry results in a degradation of cut quality and blade and band life.

The clearance described, which increases with age, also allows the blade to move in response to forces generated by the shearing action. This will limit the cutting performance when encountering heavier web products that require higher cutting forces.

It would therefore be beneficial if there were a means of guiding the blade assembly in an axial direction without any resulting binding or friction. It would also be beneficial if the geometry of the blade with respect to the band would not degrade over time.

SUMMARY

Disclosed is a web slitter assembly including a blade support structure and a blade housing. The blade support structure provides, among other functions, the means to mount or attach the entire assembly to an assembly frame. The blade housing serves to hold the blade and the blade's axle and bearing assembly on which the blade rotates. In operation, the blade housing is guided in the blade's axial direction to contact the band with a prescribed amount of force.

The blade housing is attached and connected to the support structure by means of two parallel flexible members or walls. The plane of flexing of the parallel walls is so arranged to be in the axially direction, the direction in which the blade is to be guided. The flexible walls are rigidly attached to the blade support structure and to the lower frame. When a force is applied to move the lower frame and thus the blade axially, all motion is a result of flexing in the parallel walls. There are no clearance dependent connections. There is no relative motion between contacting parts and therefore there is no wear.

When proper proportions of the length and thickness of the flexing walls and the extent of the axial motion are used, stresses and required forces for actuation are small. When so designed, fatigue life of the flexing walls is sufficiently long as not to be of concern.

In one embodiment, a rigid plate is fixed to each flexible member near its midpoint. The disclosed mechanism also includes a diaphragm to apply the force that causes the axial motion and provides the force to load the blade against the band. Use of a diaphragm eliminates possible friction forces found in many actuators.

DRAWINGS

Figure 1:
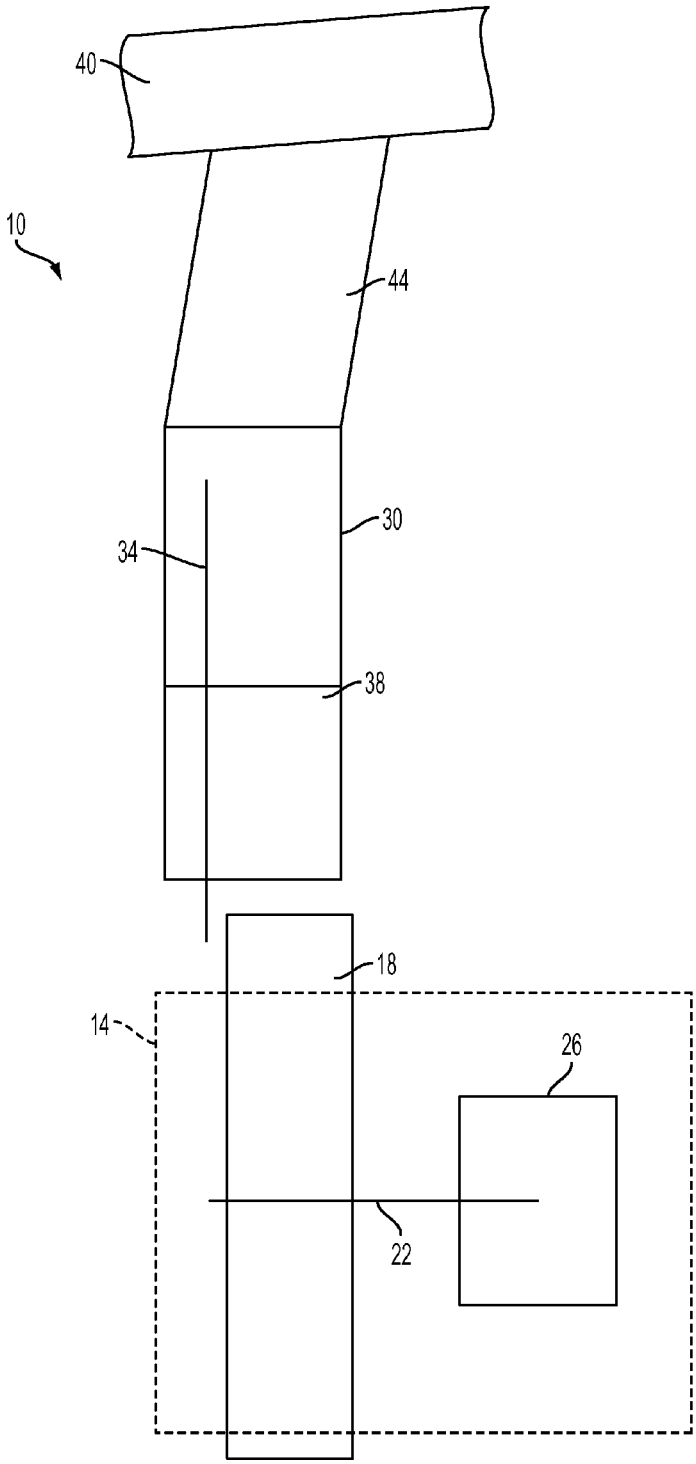
FIG. 1 is a schematic cross sectional side view of a web slitter assembly.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward", "downward", "side", "top" and "bottom", etc., are words of convenience and are not to be construed as limiting terms.

DESCRIPTION OF AN EMBODIMENT

Illustrated in FIG. 1 is a web slitter assembly 10 according to this disclosure. The web slitter 10 comprises a band support 14, and a circular band 18 supported for rotation about a band axis 22 in the band support 14. A motor 26 rotatable drives the band 18 about the band axis 22.

The web slitter assembly 10 also includes a blade housing 30, and a circular blade 34 supported for rotation about a blade axis 38 in the blade housing 30. The web slitter assembly 10 also comprises a blade support structure 40. When the blade 34 is placed aside the band 18 and pressed against the side of the band 18 with the appropriate amount of force, the band 18 rotates under the power of its motor 26 and causes a similar rotation of the blade 34. Together, the blade 34 and band 18 create a slitter with a form of scissor action that serves to sever a web (not shown) passing through the slitter.

The amount of force used to press the blade 34 against the side of the band 18 is adjustable by a mechanism 44, depending on the type of material and size of material in the web, in order to optimize the cutting of the web and reduce the amount of wear on the blade 34 and band 18.

In order to provide the proper amount of pressing force, the mechanism 44 is connected to the support structure 40 and to the blade housing 30 for holding the blade housing 30 adjacent the band 18 so that the side of the blade 34 contacts the side of the band 18 with an appropriate amount of force.

Figure 2A:
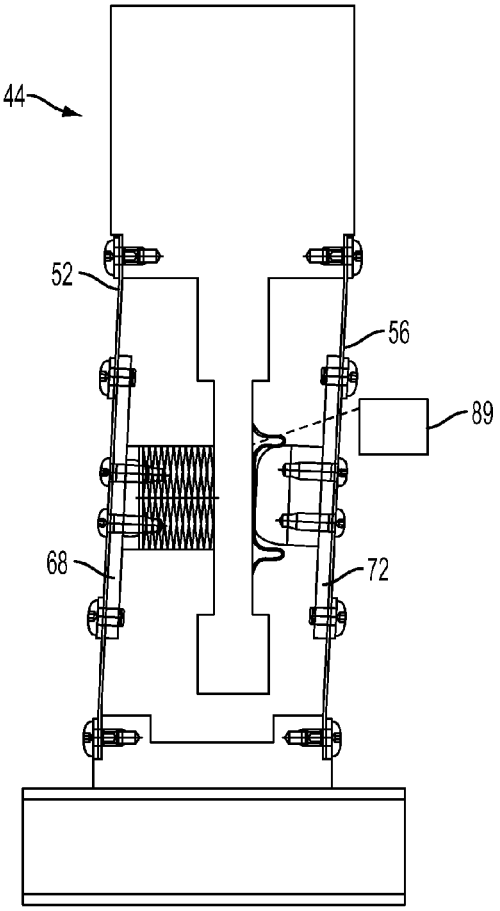
FIG. 2A is a schematic cross sectional side view of a portion of the web slitter assembly of FIG. 1, with a mechanism according to this disclosure for holding a blade against a band.
Figure 2B:
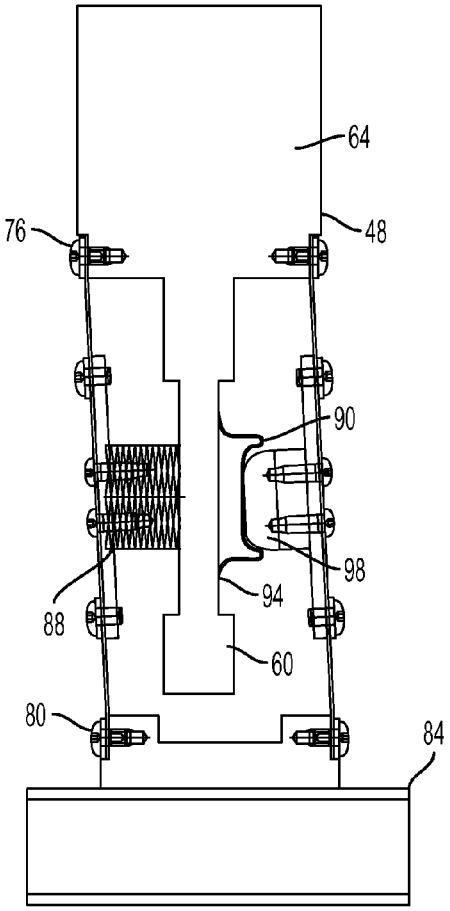
FIG. 2B is a view of the portion of FIG. 2A with the mechanism having moved a lower frame connected to the blade.

As illustrated in FIGS. 2A and 2B, the improved mechanism 44 of this disclosure comprises a body 48 connected to the support structure 40 (see FIG. 1), and a pair of parallel flexible members or walls 52 and 56 spaced apart and on opposite sides of a portion 60 of the body 48. More particularly, as illustrated in FIG. 2, the body 48 includes a top block 64 that is connected to the support structure 40, and the narrower dumbbell shaped portion 60 of the body 48 that extends downwardly from the top block 64.

Each wall 52 and 56 includes a rigid plate 68 and 72 attached, such as by screws, to its respective flexible wall. The rigid plate 68 and 72 is fixed to the central portion of the flexible wall. In less preferred embodiments (not shown), the plate can be omitted. In another embodiment (not shown), the flexible wall can be replaced with two flexible members, one attached to each end of its rigid plate.

In the illustrated embodiment, the flexible wall is made from spring steel. In other less preferred embodiments (not shown), other materials, such as an elastomer, can be used.

The purpose of the rigid plate is to essentially eliminate any twist about the "Z" axis (vertical) that would result from a moment applied about the "Z" axis. Such twist could degrade the geometry between the blade 34 and band 18. Proportions of the length of the rigid plate and the overall length and thickness of the flexible walls will determine the success of preventing the "Z" axis twist.

The upper ends 76 of the flexible walls are attached, such as by screws, to top block 64 which in turn, is connected to the support structure 40. The lower ends 80 of the flexible walls are attached, such as by screws, to a lower frame 84, and the lower frame is attached to the blade housing 30 (see FIG. 1).

The mechanism 44 further includes a bias device, in the form of a wave spring 88, extending between one of the plates 68 and the body portion 60, and attached to the rigid plate 68, such as by screws. The mechanism 44 also includes moving means for moving a flexible wall relative to the body portion 60 in the form of an inflatable diaphragm 90 adjacent and attached to the body portion 60 opposite the bias device 88. In other less preferred embodiments (not shown), other moving means, such as a solenoid, can be used. Also, in other less preferred embodiments (not shown), the bias device can be omitted if a moving means is attached to the body portion 60 and to the rigid plate 72.

The inflatable diaphragm 90 is located between the body portion 60 and the plate 72. More particularly, in this embodiment, the bias device 88 and the inflatable diaphragm 90 contact the narrow central area 94 of the dumbbell shaped body portion 60. A bumper 98 is adjacent the diaphragm 90 and is attached to the plate 72.

Inflation and deflation of the illustrated diaphragm 90 causes movement of the rigid plate 72 attached to the flexible wall 56 adjacent the diaphragm 90, which in turn also flexes the other flexible wall 52, since both are connected to the lower frame 84. When deflating the diaphragm 90, as shown in FIG. 2A, the bias device 88 serves to aid in the movement of the flexible wall 56 back toward the body portion 60. Conventional means 89 are also provided for inflating and deflating the diaphragm 90.

In the mechanism 44, the walls 52 and 56 are planar pieces. In other less preferred embodiments (not shown), the walls 52 and 56 can be provided by a cylinder, a hollow rectangular body, or some other appropriate structure or shape, provided the selected shape still allows for controlled movement of the blade in the blade axis direction. The shapes of the rigid plates would also be adjusted accordingly.

In other words, the lower frame 84 serves to hold the blade 34 and the blade's axle 38 and bearing assembly on which the blade 34 rotates. In operation, the lower frame 84 is guided in the blade's axial direction to contact the band 18 with a prescribed amount of force. The lower frame 84 is attached and connected to the support structure 40 by means of the two parallel flexible walls 52 and 56.

The plane of flexing of the parallel walls 52 and 56 is so arranged to be in the axially direction, the direction in which the blade 34 is to be guided. The flexible walls 52 and 56 are rigidly attached to the support structure 40 and to the lower frame 84.

The disclosed mechanism 44 thus provides a means of guiding the blade housing 30 in an axial direction without any resulting binding or friction. This mechanism 44 accomplishes this guiding without any mating parts moving relative to one another. This provides an axial load between the blade 34 and band 18 which is significantly more accurate and essentially unaffected by run out or external disturbances arising during operation.

Another benefit of the mechanism 44 is that the geometry of the blade 34 with respect to the band 18 will not degrade over time as all wear has been eliminated in the guiding assembly.

When a force is applied to move the lower frame 84 and thus the blade 34 axially, all motion is a result of flexing in the parallel walls 52 and 56. There are no clearance dependent connections. There is no relative motion between contacting parts and therefore there is no wear. With proper proportions of the length and thickness of the flexing walls and the proper extent of the axial motion, stresses and required forces for actuation are small. When so designed, fatigue life of the flexing walls will be sufficiently long as not to be of concern.

In the disclosed mechanism 44, no binding or friction is generated when axial motion applies the force that causes the axial motion and provides the force to load the blade 34. In the mechanism, the force is applied to the rigid plate 68 or 72 described above. By having the flexible wall between the lower frame 84 and the point of applied force, the lower frame 84 is free to move in response to any disturbance at the contact or cutting point. Again, using the correct proportions for the flexible walls is important so as not to generate significant force variations due to any such disturbances. Use of the diaphragm 90 eliminates possible friction forces found in many actuators. The coupling of the diaphragm 90 with the flexible wall is better than coupling of the diaphragm 90 directly to the lower frame 84. This would be subject to frictional forces at the point of coupling.

Various other features of this disclosure are set forth in the following claims.

The invention claimed is:

1. A web slitter assembly comprising:

a band support, a band supported for rotation about a band axis in the band support, a motor for rotatable driving the band about the band axis, a blade housing, a blade supported for rotation about a blade axis in the blade housing, a blade support structure, and a mechanism connected to the support structure and to the blade housing for holding the blade housing adjacent the band so that a side of the blade contacts a side of the band, the mechanism comprising:

a body connected to the support structure, and a pair of flexible walls spaced apart and on opposite sides of a portion of the body, each of the walls having an upper end and a lower end, the upper ends of the flexible walls being attached to the support structure, and the lower ends of the flexible walls being attached to the blade housing, and moving means for moving the flexible walls relative to the portion of the body, the moving means being located between the portion of the body and the flexible wall.

2. A web slitter assembly comprising:

a band support, a band supported for rotation about a band axis in the band support, a motor for rotatable driving the band about the band axis, a blade housing, a blade supported for rotation about a blade axis in the blade housing, a blade support structure, and a mechanism connected to the support structure and to the blade housing for holding the blade housing adjacent the band so that a side of the blade contacts a side of the band, the mechanism comprising:

a body connected to the support structure, and a pair of flexible walls spaced apart and on opposite sides of a portion of the body, each wall including a plate, and having an upper end and a lower end, the upper ends of the flexible walls being attached to the support structure, and the lower ends of the flexible walls being attached to the blade housing, and a bias device extending between one of the plates and the portion of the body, and an inflatable diaphragm adjacent the portion of the body opposite the bias device, the inflatable diaphragm being located between the portion of the body and the other of the plates.

3. A web slitter assembly according to claim 2 wherein the upper ends of the flexible wall are attached to the body that is attached to the support structure.

4. A web slitter assembly according to claim 2 wherein the mechanism further includes a lower frame, and the lower frame is connected to the blade housing.

5. A web slitter assembly according to claim 2 wherein the bias device comprises a wave spring.

6. A web slitter assembly according to claim 2 wherein the mechanism further includes a bumper adjacent the diaphragm and attached to the other of the plates.

7. A web slitter assembly according to claim 2 wherein the rigid plate is fixed to a central portion of the flexible wall.

8. A web slitter assembly according to claim 2 wherein the flexible walls are parallel.

9. A web slitter assembly according to claim 2 wherein the blade is circular.

10. A web slitter assembly according to claim 2 wherein the band is circular.

11. A web slitter assembly according to claim 2 wherein the flexible walls are made from spring steel.

12. A web slitter assembly comprising:

a band support, a circular band supported for rotation about a band axis in the band support, a motor for rotatable driving the band about the band axis, a blade housing, a circular blade supported for rotation about a blade axis in the blade housing, a blade support structure, and a mechanism connected to the support structure and to the blade housing for holding the blade housing adjacent the band so that a side of the blade contacts a side of the band, the mechanism comprising:

a body connected to the support structure, and a pair of parallel flexible walls spaced apart and on opposite sides of a portion of the body, each wall including a plate fixed to a central portion of the flexible wall, and having an upper end and a lower end, the upper ends of the flexible walls being attached to the support structure, and the lower ends of the flexible walls being attached to the blade housing, and a bias device extending between one of the plates and the portion of the body, an inflatable diaphragm adjacent the portion of the body opposite the bias device, the inflatable diaphragm being located between the portion of the body and the other of the plates, and a bumper adjacent the diaphragm and attached to the other of the plates.

13. A web slitter assembly according to claim 12 wherein the flexible walls are made from spring steel.

* * * * *